US012035758B2

(12) United States Patent
Handler

(10) Patent No.: US 12,035,758 B2
(45) Date of Patent: Jul. 16, 2024

(54) GARMENT WITH DEPLOYABLE MASK

(71) Applicant: Jamie Handler, Jamaica, NY (US)

(72) Inventor: Jamie Handler, Jamaica, NY (US)

( * ) Notice: Subject to any disclaimer, the term of this patent is extended or adjusted under 35 U.S.C. 154(b) by 440 days.

(21) Appl. No.: 17/213,670

(22) Filed: Mar. 26, 2021

(65) Prior Publication Data

US 2022/0175051 A1 Jun. 9, 2022

(51) Int. Cl.
*A41B 3/00* (2006.01)
*A41D 13/11* (2006.01)

(52) U.S. Cl.
CPC ..... *A41B 3/00* (2013.01); *A41D 13/1161* (2013.01)

(58) Field of Classification Search
CPC ..... A41B 3/00; A41D 13/1161; A41D 27/18
See application file for complete search history.

(56) References Cited

U.S. PATENT DOCUMENTS 4,827,923 A * 5/1989 Bishop ..... A41D 13/11 128/207.18
6,418,559 B1 * 7/2002 Wrecsics ..... A41D 1/04 2/127
7,228,858 B2 * 6/2007 Baker ..... A41D 15/00 2/9
9,616,258 B2 * 4/2017 Tsuei ..... B65H 45/24
D960,487 S * 8/2022 Fain ..... D2/500
D977,226 S * 2/2023 Song ..... D2/750
D977,779 S * 2/2023 Zhou ..... D29/108
2007/0051370 A1 * 3/2007 Baker ..... A41D 13/11 128/206.19
2009/0307823 A1 * 12/2009 Matsushita ..... A41D 1/04 2/116
2014/0224261 A1 * 8/2014 Tsuei ..... A62B 23/025 156/159
2021/0298376 A1 * 9/2021 Stern ..... A41D 27/18
2022/0039493 A1 * 2/2022 Thompson ..... A41D 13/1161
2022/0061404 A1 * 3/2022 Horwatt ..... A41B 1/08
2022/0087335 A1 * 3/2022 Lorenz ..... A41D 27/18
2022/0175051 A1 * 6/2022 Handler ..... A41D 27/18
2022/0183397 A1 * 6/2022 Hoff ..... A41D 13/1161
2022/0212041 A1 * 7/2022 Reichmann ..... A41D 13/1161
2023/0037727 A1 * 2/2023 Escontrias ..... A41D 27/18

OTHER PUBLICATIONS https://www.shopamericanthreads.com/products/moving-on-convertible-mask-top (Year: 2020).*

* cited by examiner

*Primary Examiner* — Khaled Annis
(74) *Attorney, Agent, or Firm* — Donn K Harms

(57) ABSTRACT

An upper garment positionable upon the torso of a user is provided with an annular collar portion extending from a head and neck opening. The annular collar is deployable from a retracted position appearing as a turtleneck style collar to a deployed position wherein a face mask is formed. The collar is held in the deployed position by ear openings therein which engage over opposing ears of the user.

4 Claims, 4 Drawing Sheets

GARMENT WITH DEPLOYABLE MASK

BACKGROUND

1. Field of the Invention

The invention relates to clothing such as shirts, tops and blouses. More particularly, the disclosed device relates to a garment having a neck portion which is employable as a face mask as well as providing a turtle neck style collar.

2. Prior Art

Upper body garments have been manufactured and sold throughout the world for decades. Such upper body garments such as shirts and blouses and the like, conventionally have a body portion which is configured for positioning on the torso of the wearer. Side openings on the garment body are conventionally configured for positioning of the arms of a wearer therethrough. These side openings are provided without sleeves, with short sleeves extending partially down the arm of the wearer, and with long sleeves which extend substantially between the shoulder and wrist of the wearer.

Such upper body garments also conventionally include a neck opening at an upper end of the body of the garment. This neck opening allows for a communication of the head and neck of the wearer therethrough. The perimeter of this neck opening can simply be reinforced such as with a T-shirt or may have a collar positioned thereon.

The fabric forming the body and sleeves of such garments is conventionally a flexible fabric material formed by weaving or knitting or other conventional means for interweaving fibers or yarn forming the garment. Depending on the intended use, the fabric may be formed of natural or synthetic yarns and fibers or mixtures thereof. Except for water and fluid proof garments which may have a fluid impervious coating thereon, conventionally such torso worn garments will have mesh openings positioned within the fibers and yarns which form the fabric material. Such openings allow for air flow through the fabric of the garment when worn.

The forgoing examples of related art as to garments and to garments and limitations related therewith, are intended to be illustrative and not exclusive, and they do not imply any limitations on the invention described and claimed herein. Various limitations of the related art will become apparent to those skilled in the art upon a reading and understanding of the specification below and the accompanying drawings.

SUMMARY OF INVENTION

The garment device herein disclosed and described features an upper garment which is formed from flexible fabric which may be woven, knitted, or otherwise manufactured. The disclosed upper garment herein is configured for positioning on the torso of a user to cover the front and back of the chest of the user wearing it.

The garment herein has a body formed of the flexible fabric. On opposing sides of the body of the garment device, herein, are positioned arm openings through which the arms of a user are located when wearing the body of the garment. These arm openings may be simply reinforced therearound, or they may have short or long sleeves engaged therewith through which the arms of the user are positioned.

At the top end of the body forming the garment, is located the neck opening. This neck opening is surrounded by an annular collar which forms what is commonly known as a turtle neck style collar. This collar has a retraced position wherein preferably an annular end portion of the collar having triangular openings therein and tethers, is positioned in a sandwiched positioning in-between a base annular portion and an end portion of the collar.

Flexible textile fabric forms both the body and collar of the garment herein. By flexible textile fabric is meant herein, fabric formed by weaving, knitting, or other manner of interlocking threads or yarn in a manner forming mesh openings within the surrounding yarn and fibers forming the weave of knit of the fabric. For the body of the garment, these openings can be larger than the openings formed in the fabric forming the collar. The collar, in addition to having smaller mesh openings than the fabric of the body portion, preferably includes from 5-15% elastic yarn in the weave or knitted material. Such will allow the fabric forming the collar, when deployed as a mask, to stretch and more comfortably accommodate the shape of the face and nose of the user in the deployed configuration. Thus, including elastic yarn such as that formed from polyethylene as a portion of the yarn used for the warp and weft of the material is preferred for at least the collar.

Additionally included in the collar are a first opening and a second opening formed on an opposite side of the collar. The openings are formed in the annular end portion of the collar adjacent the second end of the collar. In a preferred mode for comfort and performance, the openings are triangular in shape, with two sides extending from the lowest point of the triangle at respective angles away from each other to an end of the opening which has an elastic tether engaged with both sides.

With respect to the above description, before explaining at least one preferred embodiment of the herein disclosed garment having a protective mask in detail, it is to be understood that the disclosed garment herein is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed garment having a collar portion employable as a mask. It is important, therefore, that the claims be regarded as including such equivalent construction and methodology insofar as they do not depart from the spirit and scope of the present invention.

As used in the claims to describe the various inventive aspects and embodiments, "comprising" means including, but not limited to, whatever follows the word "comprising." Thus, use of the term "comprising" indicates that the listed elements are required or mandatory, but that other elements are optional and may or may not be present. By "consisting of" is meant including, and limited to, whatever follows the phrase "consisting of." Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements. By the term "substantially" if not otherwise defined, is meant plus or minus ten percent.

It is an object of the present invention to provide a garment which can be worn and provide the user a collar portion which in a stowed configuration forms a turtle neck.

It is another object to provide the garment herein wherein the collar portion can be extended from a folded position and held elevated to hold a front portion of the extended collar covering the mouth and nose of the user.

These and other objects, features, and advantages of the present disclosed garment invention, as well as the advantages thereof over existing prior art, which will become apparent from the description to follow, are accomplished by the improvements described in this specification and hereinafter described in the following detailed description which fully discloses the invention, but should not be considered as placing limitations thereon.

BRIEF DESCRIPTION OF THE DRAWINGS

The accompanying drawings, which are incorporated herein and form a part of the specification, illustrate some, but not the only or exclusive, examples of embodiments and/or features of the garment invention herein. It is intended that the embodiments and figures disclosed herein are to be considered in all cases illustrative, rather than limiting.

In the drawings.

Figure 1:
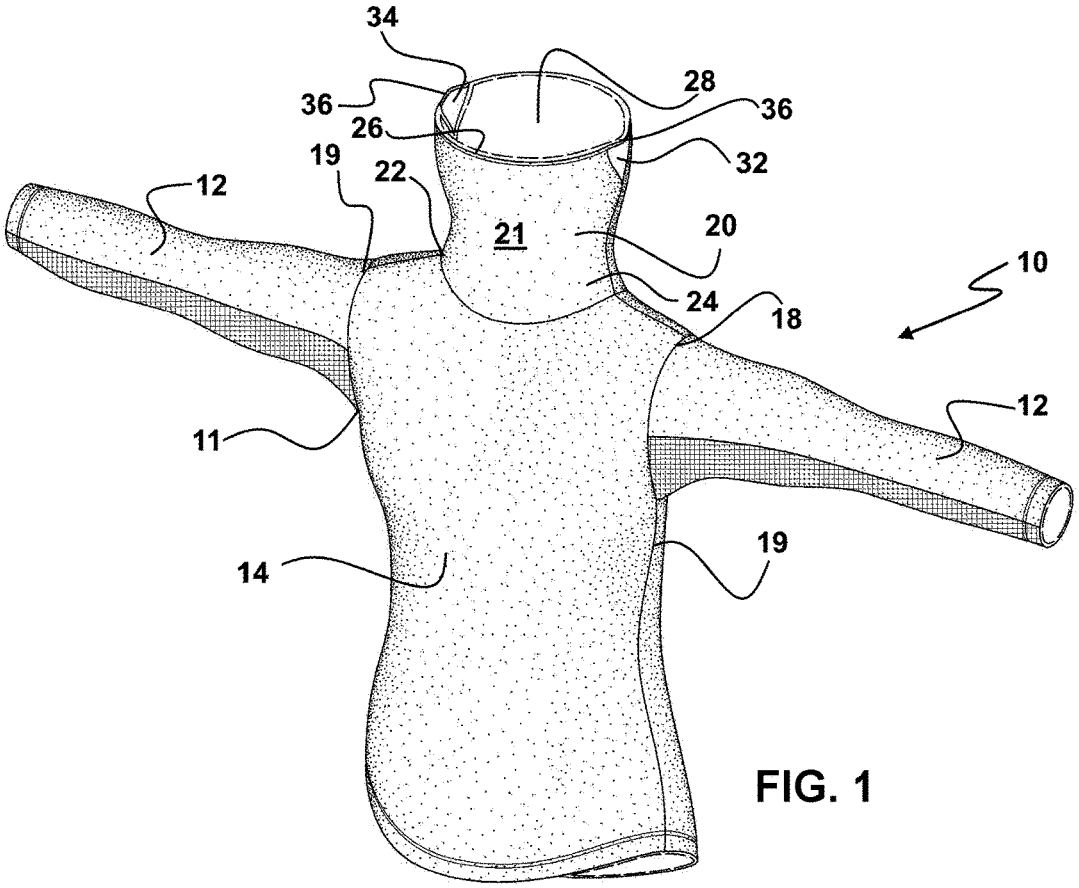
FIG. 1 shows a front perspective view of a mode of the garment herein, showing a neck portion in an as-used or deployed positioning.

Other aspects of the disclosed garment with deployable collar herein will be more readily understood when considered in conjunction with the accompanying drawings, and the following detailed description, neither of which should be considered limiting.

DETAILED DESCRIPTION OF EMBODIMENTS

In this description, any directional prepositions if employed, such as up, upwardly, down, downwardly, front, back, first, second, top, upper, bottom, lower, left, right and other such terms referring to the device or depictions as such may be oriented, are describing it such as it appears in the drawings and are used for convenience only. Such terms of direction and location are not intended to be limiting or to imply that the device herein has to be used or positioned in any particular orientation.

Now referring to drawing of FIGS. 1-6, where similar components are identified with like numeral references, there is seen in FIG. 1 a front perspective view of a mode of the garment device 10. While shown with long sleeves 12, the garment device 10, herein, can also be provided with shorter length sleeves 12 which would extend down a portion of the arm of the user rather than the entire arm.

Figure 2:
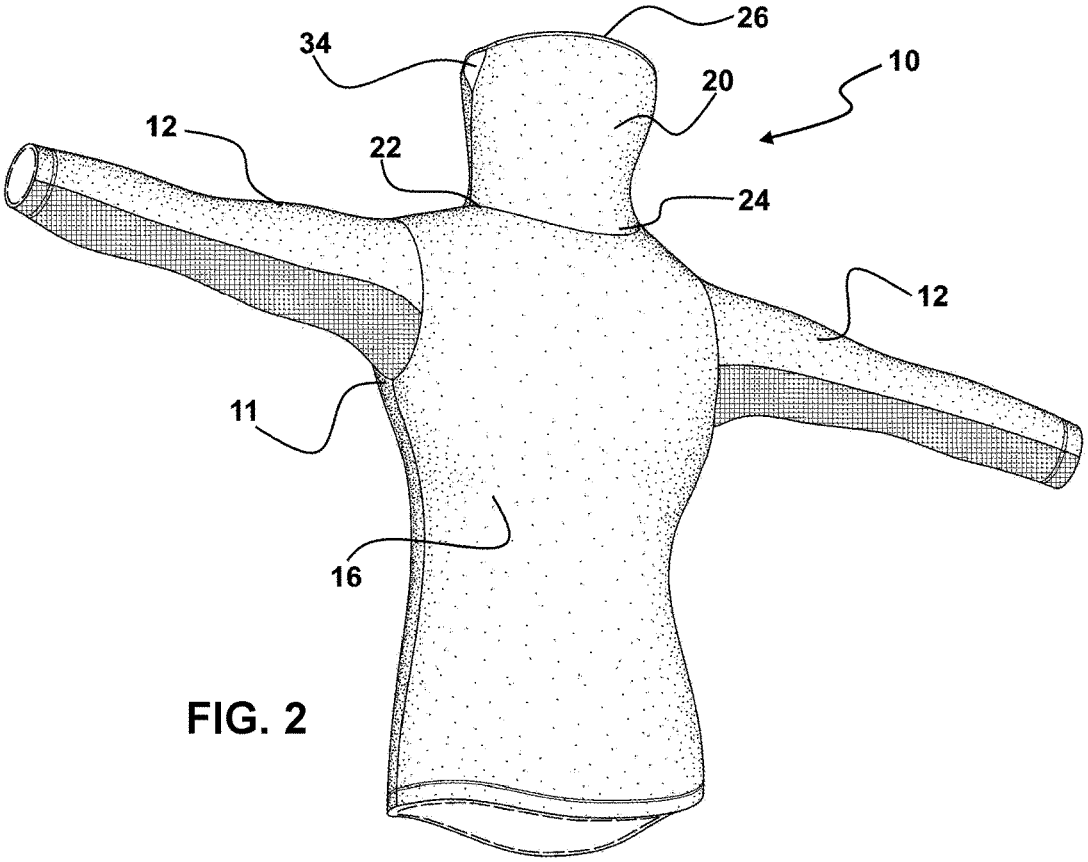
FIG. 2 shows a rear perspective view of the garment of FIG. 1.

As shown in FIGS. 1-2, the garment device herein has a body 11 having a front panel 14 operatively engaged to a rear panel 16. The front panel 14 and rear panel 16 are engaged such as by a seam 19 using sewing to form an encircling body 11 to cover for the torso of the wearer when worn.

Each of the two sleeves 12, extend from openings 18 formed at an upper end of the body 11 of the garment device 10 and are formed with interior passages for positioning of respective arms of the user therethrough.

Also shown is the collar 20. The collar 20 has a first end 24 which is engaged to or extends from a neck opening 22 at an upper end of the body 11 of the garment device 10. The collar 20 extends to a second end 26 or distal edge which forms a neck opening 28 through which the head and neck of the user extends with the garment device 10 in an as-used positioning where it is being worn in a conventional fashion of a shirt by a user.

Figure 3:
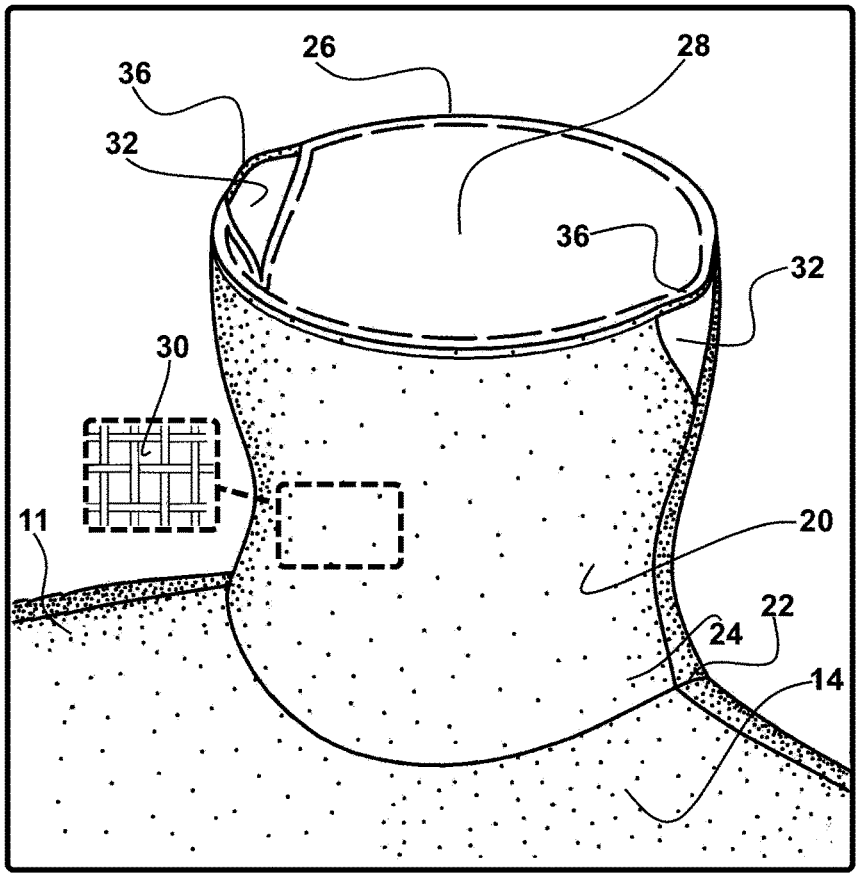
FIG. 3 shows a depiction of the collar portion of the garment herein enlarged to show two openings on opposing sides of the collar body and shows an enlarged portion of the woven or knitted textile fabric showing the openings therein.

In FIG. 3 is depicted the collar 20 portion of the garment device 10 herein where the collar 20 has been enlarged to more easily show the components thereof. Also shown is an enlarged section of the textile fabric forming the collar 20 which shows the woven or knitted warp and weft threads forming mesh openings 30 therebetween.

The textile fabric forming the body 11 and the portions thereof is preferably a knitted or woven textile fabric formed of natural or synthetic yarn material such as for example cotton, nylon, polyester or other conventional shirt textile fabrics, or mixtures thereof. Particularly preferred are the inclusion of yarns forming the textile fabric of the body 11 which includes elastic yarn in the warp and weft such as polyurethane, forming between 5-15% of the total yarn forming the textile fabric, which will allow the textile fabric to stretch in two directions for comfort.

The mesh openings 30 which are formed in between the warp and weft yarns of woven or knitted textile fabric forming the body 11, are sized with an area therein in a range between 50 to 825 nanometers (nm). The collar 20 may be formed of the same material as the body 11 and in the same weave or knit thereof, or more preferably, it may be formed with a weave or knit, wherein the openings 30 surrounded by the warp and weft yarns are in a lower end of the range above whereas the body 11 might be formed with the openings of a size much higher in the range.

Figure 5:
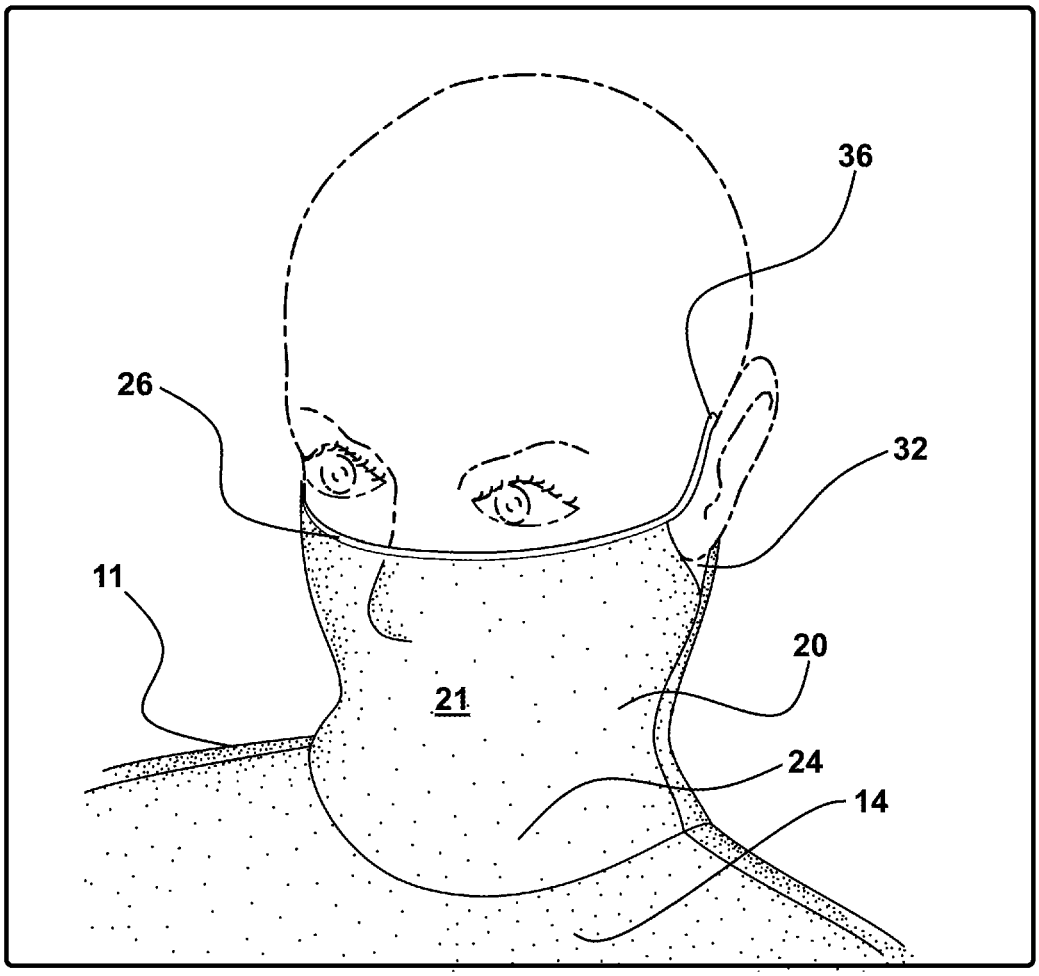
FIG. 5 shows the collar portion of the garment herein in a deployed or as-used positioning where a front collar section covers the nose and mouth of the wearer and elastic members are engaged over each ear of the user to provided a connection to the ears of the user.

The collar, as shown in FIG. 5, in an unfolded and deployed positioning covering the face of the user, can be employed by the user during periods of time they are liable to be exposed to dust and other particulate or where they may be exposed to a virus or other pathogen. Since the collar 20 when deployed to cover the nose and mouth of the user as in FIG. 5, is so positioned to filter particulate and pathogens from the air breathed by the user, openings 30 formed between the warp and weft threads which are woven or knotted would preferably be sized between 50 to 100 nanometers in the most effective mode of the collar 20 to block both particulate in the air as well as pathogens such as a virus. Where particulate such as drywall dust, sawdust, or dust in a storm is anticipated as the primary use for the collar 20, woven or knitted textile fabric forming the collar 20 having openings 30 sized between 200-800 nm could be employed.

Also shown in FIG. 3 is the collar 20 portion of the garment device 10 herein enlarged to more clearly show a first opening 32 formed therein, and a second ear opening 34 formed therein on an opposite side of the collar 20. While the textile fabric forming the collar 20 at the second end 26 thereof could form one side of the triangular openings, preferably there extends across one side of each ear opening 32 and 34 is an elastic tether 36, which also forms one side edge thereof by extending across a gap formed in the distal edge of the collar 20 at the second end 26 thereof. Each elastic tether 36 is configured to stretch and secure over the top of a respective ear of a user when that ear is positioned within the respective ear opening 32 and 34 as shown in FIG. 5.

Figure 4:
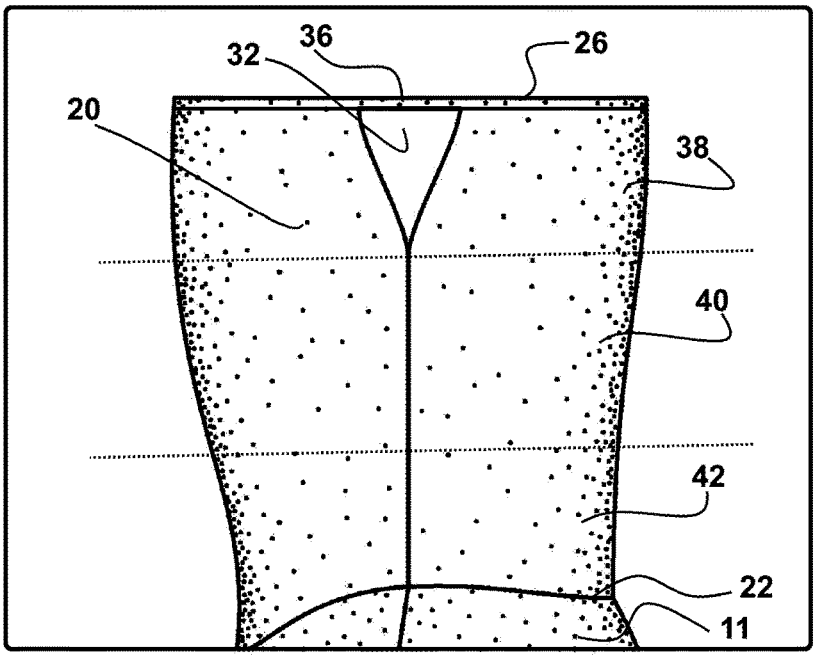
FIG. 4 shows a side view of the collar portion of the garment depicted in FIG. 3, showing the preferred V-shaped or triangular shaped opening extending to a gap in the distal edge of the collar having a tether therein, and showing the preferred length of the collar from neck opening to the second end, allowing for a triple fold of the collar portion to a stowed positioning shown in FIG. 6.

The first ear opening 32 and second ear opening 34 are shown in FIGS. 3-4 as being V-shaped or triangular in shape. As shown and preferred, the elastic tether 36 forms one of the three triangular side edges forming each ear opening 32 and 34. The openings 32 and 34 might be formed of other shapes such as rectangles, or circles, or ellipses or the like, and such is anticipated within the scope of this patent. However, it was found in experimentation with different shaped openings 32 and 34 that a triangular shape with the elastic tether 36 forming one side edge thereof worked much easier for the user to align with a respective ear and position each ear within an ear opening with an elastic tether 36 contacting a top edge of the ear.

It was also determined in addition to the ease of placing ears into respective ear openings, the V-shape or triangular shapes of the ear openings 32 and 34, with the elastic tether 36 forming one side, better maintained the round or annular shape of the collar 22 over time as well as helping to prevent raveling of the textile fabric forming the collar 22. Additionally, the triangular shape was found to be more comfortable when positioned around the ear of a user which was attributed to the forward and rearward sweeping angles of the two vertical slanting side edges of the triangle shaped openings 32 and 34 forming a better fit with the exterior shape of the ear of the user on opposite sides thereof, by the two opposing sides away from a narrow lower end. As such, a triangular shape is most preferred for the ear openings 34 and 36, with one side of each ear opening 34 and 36 where it intersects with the second end 26 of the collar 20 formed by the elastic tether 36. Further, the triangular shape preferably has two side edges extending from a lowest point of the openings at angles away from each other to the intersection with the second end 26 of the collar 20. At the second end, at or forming the third side of the triangular shape is positioned the elastic tether 36.

Additionally shown in FIG. 4 is the forming of the collar 20 in a length thereof extending between the neck opening 22 and the second end 26 or distal edge of the collar 20. Currently, that length is such that an end portion of the collar 38 extends between the second end 26 of the collar and an imaginary line adjacent the intersection of the two angled sides of the ear opening 32 or 34. Experimentation has found that a length of the collar 20 from the neck opening 28 to the edge at the second end of the collar 20 of between 6-8 inches works well to allow for the preferred sandwiched folding while being long enough to deploy and cover the mouth and nose of most adults. As such, while a shorter length of the collar 20 may work well with children, or work with adults without the sandwiched fold noted herein, using the length of 6-8 inches provides much more utility to allow for the sandwiched folding and a comfortable covering of adult faces.

Adjacent the end portion 38 is a central portion 40 of the collar 20 and in between the central portion 40 of the collar 20 and the body 11 of the garment device 10 is located a base portion 42 of the collar 20. This configuration is especially preferred in order to allow the collar 20 to fold to the position shown in FIG. 6 in a manner which positions the end portion 38 of the collar 20 in between the base portion 42 and the central portion 40. This configuration was found to eliminate the possibility of the elastic tethers 36 from catching on projections and the like encountered by the user, by placing the tether 36 and openings in a protected or sandwiched position in between the other two sections as shown in FIG. 6 in the enlarged depiction of the collar 20 folding.

Figure 6:
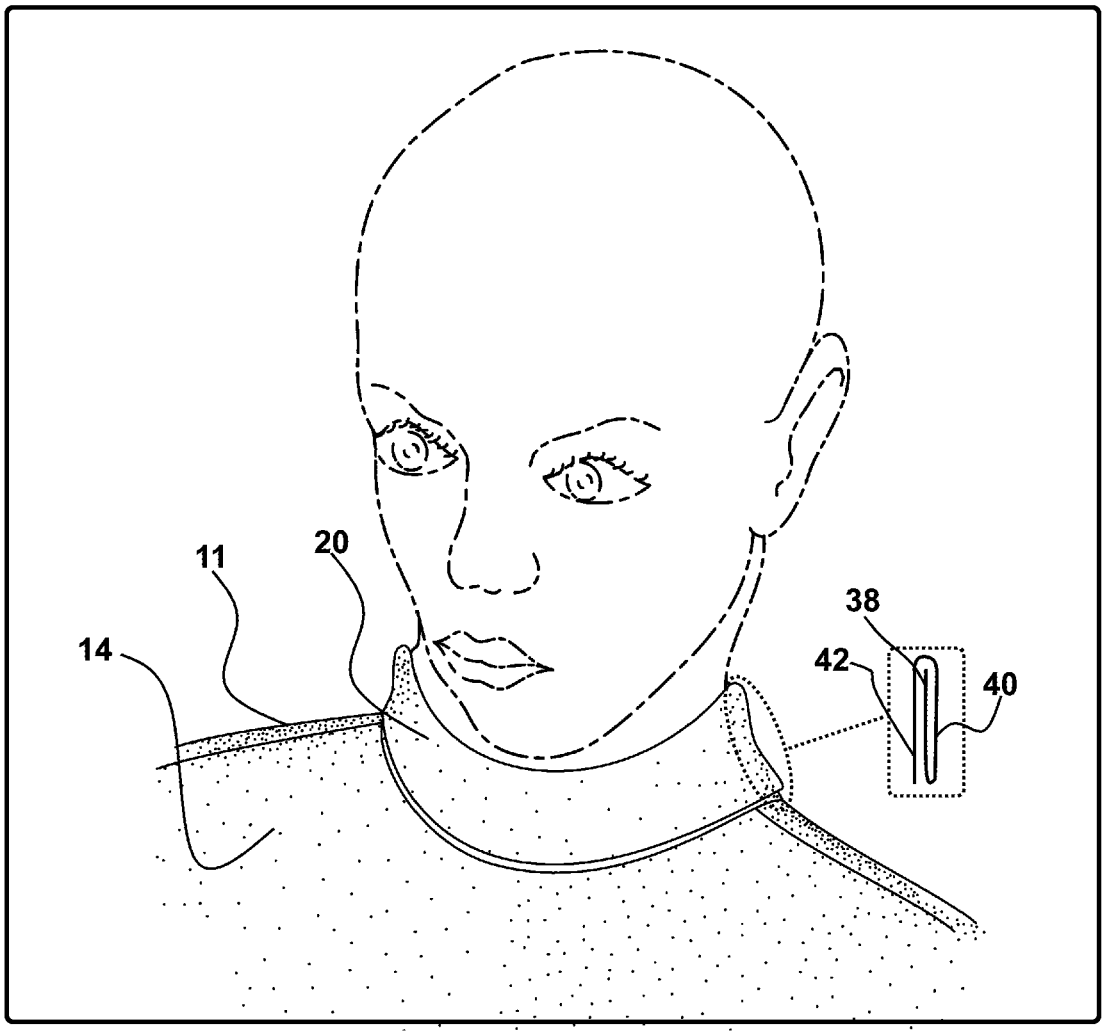
FIG. 6 shows the collar of the garment herein wherein it as been double folded to overlap three sections thereof and locate both openings sandwiched between an exposed central area of the folded collar and an underlying lower portion of the collar.

In FIG. 5 is shown the collar 20 portion of the garment device 10, herein, unfolded from the retracted position of FIG. 6, to a deployed or as used positioning. As shown, a front collar section 21 is held in position to cover the nose and mouth of the wearer and thereby filter air through the mesh openings 30 in the textile fabric forming the collar 20. Also shown, are the elastic tether 36 in contact with and extending over the top of the ear of the user which is positioned within the first ear opening 32 shown. The second ear opening 34 and elastic tether engaged therewith engages with the opposite ear of the user in the same fashion.

Shown in FIG. 6 is the garment device 10 wherein the collar 20 engaged with the body 11 is folded to place the end portion 38 thereof sandwiched between the central portion 40 and the base portion 42. As noted, this folding positions both ear openings 32 and 34 and both elastic tethers 36 hidden and protected from catching projections surrounding the user or the fingers or thumbs of the user moving their hands near their head.

While all of the fundamental characteristics and features of the disclosed garment with a neck portion deployable as a mask herein have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A garment apparatus comprising:

a garment body having a front side and a rear side, said garment body formed of flexible textile fabric;

said garment body having arm openings formed on opposing sides thereof;

said garment body having a neck opening formed at an upper end thereof;

said garment body positionable on the torso of a user;

an annular collar formed of said flexible textile fabric extending from a first end engaged to said garment body at said neck opening to a distal edge at a second end thereof;

said collar having a retracted position wherein said distal edge and an end portion of said collar adjacent thereto is folded against a portion of said collar in between said first end and said second end thereof;

said collar having a deployed position wherein said collar extends unfolded from said first end to said second end thereof said collar having a first ear opening therein positionable in a first removable engagement upon a first ear of said user with said collar in said deployed position;

said collar having a second ear opening therein opposite said first ear opening, said second ear opening positionable in a second removable engagement upon a second ear of said user with said collar in said deployed position;

said first ear opening in said first removable engagement defining a first removable connection to maintain said collar in said deployed position;

said second ear opening in said second removable engagement defining a second removable connection to maintain said collar in said deployed position;

a front portion of said flexible fabric forming a mask covering the nose and mouth of said user with said collar in said deployed position;

said flexible textile fabric forming said front portion of said annular collar having mesh openings therein; and said mesh openings having an area sized between 50 to 100 nanometers.

2. The garment apparatus of claim 1, additionally comprising:

said first ear opening being triangular in shape; and said second ear opening being triangular in shape.

3. The garment apparatus of claim 2, additionally comprising:

said triangular shape of both said first ear opening and said second ear opening formed by a respective opening having two sides thereof extending from an intersection therebetween at angles away from each other, toward said distal edge at said second end of said collar; and said two sides of each respective opening extending to respective intersections on opposite ends of a third side of each respective opening, said third side formed at said distal edge of said collar.

4. The garment apparatus of claim 3, additionally comprising:

said third side of each respective opening formed by an elastic tether, said elastic tether engaged across a gap in said distal edge of said collar.

* * * * *